United States Patent [19]

Korte et al.

[11] Patent Number: 4,528,995

[45] Date of Patent: Jul. 16, 1985

[54] SEALED PNEUMATIC TOBACCO CONVEYING AND TREATING APPARATUS

[75] Inventors: Kevin R. Korte, Louisville, Ky.; Richard D. Falter, Macon, Ga.

[73] Assignee: Brown & Williamson Tobacco Corporation, Louisville, Ky.

[21] Appl. No.: 541,752

[22] Filed: Oct. 13, 1983

[51] Int. Cl.[3] ..... A24B 3/18; F26B 3/08

[52] U.S. Cl. ..... 131/304; 131/302; 34/57 E

[58] Field of Search ..... 34/57 E; 131/304, 302, 131/301, 303

[56] References Cited

U.S. PATENT DOCUMENTS 4,214,375 7/1980 Albus et al. ..... 34/57 E 4,418,706 12/1983 Kim et al. ..... 131/304

*Primary Examiner*—V. Millin

*Attorney, Agent, or Firm*—Charles G. Lamb

[57] ABSTRACT

An apparatus for treating a tobacco as it is conveyed through the apparatus includes a heater for heating the treating and conveying gas, a tobacco-gas separator device for separating the treated tobacco from the treating and conveying gas, a duct fluidity interconnecting the heater with the tobacco-gas separator device, a venturi located in the duct, and a tobacco feed device for introducing tobacco to be treated into the throat of the venturi to be entrained by the treating gas stream between the heater device and tobacco-gas separator device. The separated treating gas is returned to the heater device for reuse in treating more tobacco. The apparatus further includes a venturi which maintains a substantially zero internal atmospheric pressure at the tobacco feed device to prevent the escape of treating gas from the apparatus or entry of ambient air into the apparatus.

24 Claims, 6 Drawing Figures

SEALED PNEUMATIC TOBACCO CONVEYING AND TREATING APPARATUS

BACKGROUND OF THE INVENTION

1. Field of the Invention

This invention relates, in general, to a system for treating tobacco, and more particularly for drying and/or expanding tobacco.

2. Description of the Prior Art

Tobacco treating apparatus which employ the tobacco treating gases for also conveying the tobacco through the apparatus are known.

By way of example, two such tobacco heating apparatuses are disclosed in U.S. Pat. No. 3,357,436 issued on Dec. 12, 1967 to A. H. Wright and U.S. Pat. No. 3,786,573 issued on Jan. 22, 1974 to John J. Scheppe and Raymond N. Carini.

U.S. Pat. No. 3,357,436 discloses a tobacco drying apparatus having an air heater interconnected to a tobacco-air separator by means of a long duct system forming a serpentine flow path of vertically oriented drying chambers. The tobacco to be dried is delivered into the duct system through a rotary valve. As the heated tobacco bearing air flows through the drying chambers, the tobacco is dried. The dried tobacco is separated from the drying air in the tobacco-air separator. After the dried tobacco is separated from the air, a portion of the air is discharged from the system and the remaining air is recirculated back to the heater. Fresh make-up air is introduced into the recirculated air upstream of the heater. This is done to lower the moisture content of the drying air.

U.S. Pat. No. 3,786,573 illustrates a tobacco drying apparatus having an air heater interconnnected to a separator by means of a long horizontal duct. Tobacco to be dried is fed into the horizontal duct through an opening therein, and ambient air is introduced into the horizontal duct downstream of the tobacco feed opening as needed to control the temperature of the drying air.

A drawback common to known tobacco treating systems of the class discussed above is that the tobacco treating gas can leak from the system through the tobacco feed device or ambient air can leak into the system through the tobacco feed system. In either event, the characteristics of the treating gas are altered with detrimental effects on the tobacco treating process.

A prior art attempt to overcome this drawback is disclosed in U.S. Pat. No. 4,377,173 issued on Mar. 22, 1983 to Ronald D. Rothchild. This patent discloses a tobacco expanding apparatus including a treating gas heating device interconnected to a tobacco-gas separator by means of a vertically oriented duct in which the expansion of the tobacco occurs. Tobacco containing solid carbon dioxide is fed into a horizontal section of duct upstream of the vertical duct through a rotary valve device. After the tobacco has been expanded, it is separated from the treating gas in the tobacco-gas separator, and the separated treating gas is returned to the gas heater for re-use in the process. In one attempt to prevent ambient air from leaking through the tobacco feed valve and into the system, some of the separated treating gas is introduced into the tobacco feed device creating an atmosphere of treating gas upstream of the tobacco feed device. In another attempt to prevent ambient air from entering the system through the tobacco feed device, a vacuum pump is connected to the tobacco feed valve to remove the atmosphere in the housing of the tobacco feed valve.

SUMMARY OF THE INVENTION

The present invention provides a tobacco treating apparatus wherein the leakage of treating gas from and leakage of ambident air into the apparatus is prevented.

More particularly, the present invention provides an apparatus for treating tobacco particles comprising heater means for heating tobacco treating and conveying gas passing therethrough, a tobacco-gas separator device located downstream of the heater means, first duct means fluidly interconnecting the gas outlet of the tobacco-gas separator device to the inlet of the heater means, gas moving means located in the first conduct means upstream of the heater means for circulating the treating-conveying gas through the apparatus, second duct means fluidly interconnecting the hot tobacco treating-conveying gas outlet of the heater means to the entrance to the tobacco-gas separator device, a converging-diverging venturi located in the second duct means sized to provide substantially a zero treating-conveying gas flow therethrough, and tobacco feed means for feeding tobacco particles to be treated into the throat of the venturi.

BRIEF DESCRIPTION OF THE DRAWINGS

A better understanding of the present invention will be had upon reference to the following specification and accompanying drawings wherein.

DETAILED DESCRIPTION OF THE PREFERRED EMBODIMENTS

Figure 1:
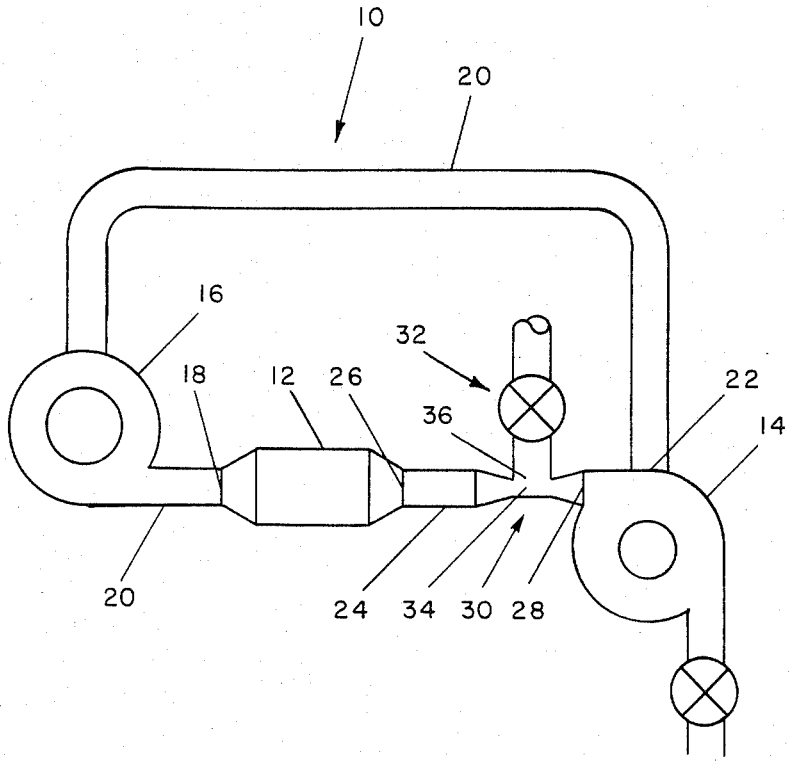
FIG. 1 is a schematic representation of one preferred embodiment of an apparatus for pneumatically conveying and treating tobacco embodying the features of the present invention.
Figure 3:
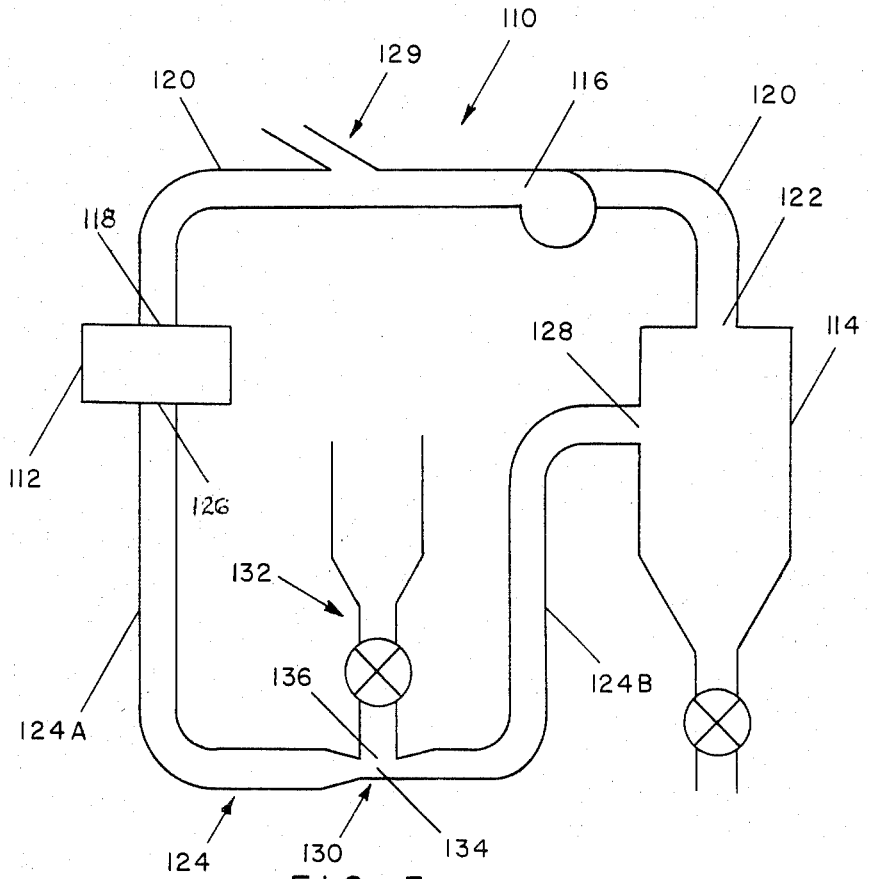
FIG. 3 is a schematic representation of another preferred embodiment of an apparatus for pneumatically conveying and treating tobacco embodying the features of the present invention.
Figure 5:
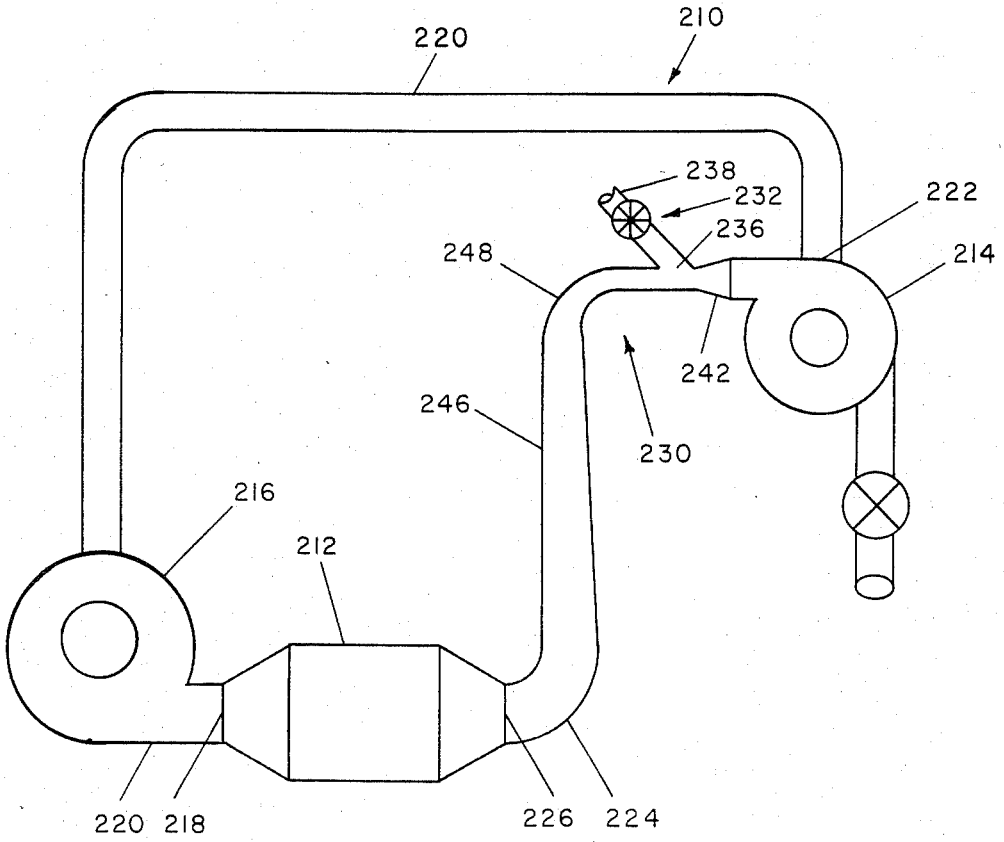
FIG. 5 is a schematic representation of a further preferred embodiment of an apparatus for pneumatically conveying and treating tobacco embodying features of the present invention; and, FIG. 6 is an enlarged view of a component of the apparatus of FIG. 5.

FIGS. 1, 3 and 5 show a pneumatic tobacco conveying and treating apparatus each embodying the features of the present invention. The apparatus will be described hereinafter for the sake of clarity, as an apparatus for drying tobacco by means of a hot air stream. However, it should be understood that it can be used for other tobacco treatments such as, for example, expanding or puffing tobacco by essentially only changing the composition of the treating gas used.

With reference to the schematic illustration of FIG. 1, there is shown a pneumatic tobacco conveying and drying apparatus, generally denoted as the numeral 10, for drying tobacco to a predetermined moisture content. The pneumatic conveying and drying apparatus 10 uses the drying gas to also convey the tobacco to be dried through apparatus 10. The apparatus 10 is depicted as comprising heater means 12, which can be of virtually any type, such as a natural gas-fired burner or electric heater, for heating a tobacco drying-conveying gas, such as air or a mixture of air and steam, a tobacco-gas separator device 14 preferably of the tangential type, and conveying gas moving means 16, such as a fan or blower located upstream of a conveying gas inlet 18 of the heater means 12. A first duct fluidly interconnects a hot conveying gas outlet 22 of the separator 14 to the inlet 18 of the heater means 12, and the conveying gas moving means 16 is operatively located in the first duct 20. A second duct 24 fluidly interconnects a hot conveying gas outlet 26 of the heater means 12 to an entrance 28 of the tobacco-gas separator device 14.

Figure 2:
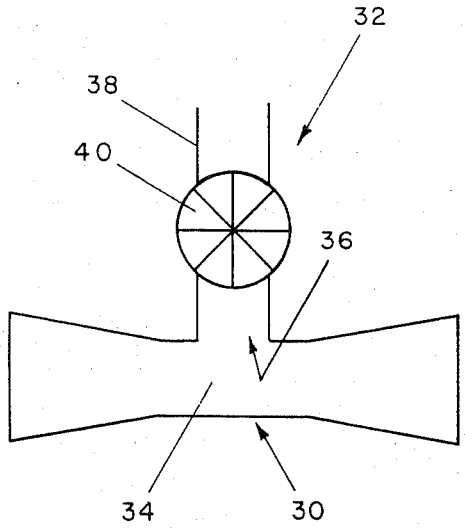
FIG. 2 is an enlarged view of a component of the apparatus of FIG. 1.

With continued reference to FIG. 1 and additional reference to FIG. 2, a converging-diverging venturi 30 is located in flow through communication in the second duct 24 between the heater means 12 and tobacco-gas separator device 14, and a tobacco feed means 32 is located to feed tobacco particles to be dried directly into the throat 34 of the venturi 30.

As can be best seen in FIG. 2, the tobacco feed means 32 comprises an aperture 36 formed in the wall of the venturi 30 at the venturi throat 34 through which the tobacco to be treated will enter into the venturi throat 34 and be entrained in the heated gas flowing from the heater means 12.

Preferably, the flow-through area of the tobacco aperture 36 in the venturi throat wall is substantially equal to the cross-sectional area of the venturi throat 34. The tobacco feed means 32 further includes tobacco conduit means 38 associated with the tobacco aperture 36 for channeling tobacco particles to be treated to the tobacco aperture 36. Gate means 40 is located in the tobacco conduit means 38 and is adapted to selectively open and close the tobacco conduit means to control the passsage of tobacco particles into the venturi throat 34. As shown, the gate means 40 is a multi-vaned rotary valve.

The converging-diverging venturi 30 is appropriately sized for the flow conditions through the apparatus 10 to provide substantially a zero treating-conveying gas static pressure in the venturi throat 34 as the gas flows therethrough. Preferably, the venturi 30 is sized to provide a slight negative treating-conveying gas static pressure of, for example, approximately 0.6 inches of water in the venturi throat 34. The slight negative static pressure is desirable in that it compensates for normal variations in the conditions of the drying-conveying gas conditions which tend to increase the static pressure and prevents a positive static pressure from occurring in the venturi throat. Normal variations in the gas flow conditions are due, for example, to fan speed variations and heating variations.

Figure 4:
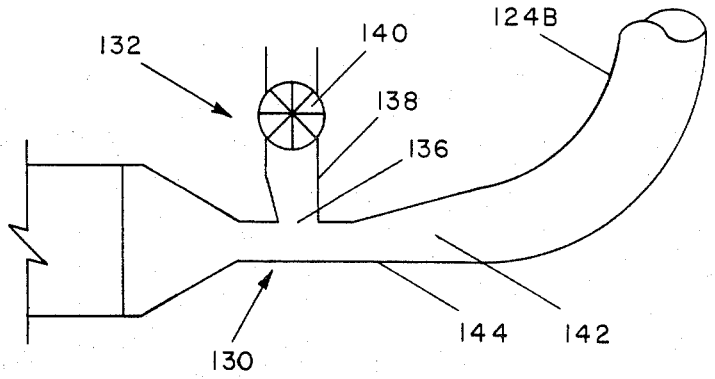
FIG. 4 is an enlarged view of a component of the apparatus of FIG. 3.

FIGS. 3 and 4 illustrate another preferred embodiment of a pneumatic tobacco conveying and drying apparatus, generally denoted as the numeral 110, for drying a tobacco to a predetermined moisture content. The apparatus 110 is shown as including heater means 112 such as, for example, a natural gas-fired burner or electric heater, for heating the tobacco drying-conveying gas, a tobacco-gas separator device 114, preferably of the tangential type, and conveying gas moving means 116, such as a fan or blower located upstream of a conveying gas inlet 118 of the heater means 112. A first duct 120 fluidly interconnects a hot conveying gas outlet 122 of the separator 114 to the inlet 118 of the heater means 112, and the conveying gas moving means 116 is operatively located in the first duct 120. A second duct 124 fluidly interconnects a hot conveying gas outlet 126 of the heater means 112 to an entrance 128 of the tobacco-gas separator device 114. The second duct 124 has a first section 124A extending a predetermined distance from the heater means outlet 126 and a generally vertical second section 124B located downstream of the first section 124A. The downstream end of the vertical duct section 124B is connected to the entrance 128 of the tobacco-gas separator device 114. The second section 124B functions as a drying chamber for the tobacco and its length is dictated by the residence time required to dry the tobacco moving upwardly therein. The apparatus 110 is also shown as including a conveying gas vent means 129 in the first duct 120 between the gas moving means 116 and heater means 112 for controllably venting conveying gas to the atmosphere as may be required in some installations to control the moisture content of the gas. As shown, the vent means 129 comprises an aperture formed in the first duct 120 with a damper thereacross to selectively control the amount of gas to be vented. With further reference to FIG. 4, a converging-diverging venturi 130 is located in flow-through communication in the first section 124A of the second duct 124 just upstream of the second vertical section 124B of the second duct 124, and a tobacco feed means 132 is located to feed tobacco particles to be dried directly into the throat 134 of the venturi 130.

As can be best seen in FIG. 4, the tobacco feed means 132 comprises an aperture 136 formed in the wall of the venturi 130 at the venturi throat 134 through which the tobacco to be treated will enter into the venturi throat 134 and be entrained in the heated gas flowing from the heater means 112. Preferably, the flow-through area of the tobacco aperture 136 in the venturi throat wall is substantially equal to the cross-sectional area of the venturi throat 134. The tobacco feed means 132 further includes tobacco conduit means 138 associated with the tobacco aperture 136 for channeling tobacco particles to be treated into the tobacco aperture 136. Gate means 140 is located in the tobacco conduit 138 and is adapted to selectively open and close the tobacco conduit means 138 to control the passsage of tobacco particles into the venturi throat 134. As shown, the gate means 140 is a multi-vaned rotary valve. Further, the tobacco feed means 132 is configured to feed or direct tobacco particles into the venturi throat 134 in the general direction of the flow of treating-conveying gas flowing through the venturi throat 134. Toward this end, as can be seen in FIG. 4, a portion of the wall of the tobacco conduit 138 is angled in the general direction of gas stream flow through the venturi throat 134. The angled conduit wall presents an obtuse angle to the venturi throat wall which functions to prevent aspiration of ambient air into the venturi throat when the gate means is opened.

The converging-diverging venturi 130 is appropriately sized for the flow conditions through the apparatus 110 to provide substantially a zero treating-conveying gas static pressure in the venturi throat 134 as the gas flows therethrough. Preferably, the venturi 130 is sized to provide a slight negative treating-conveying gas static pressure of, for example, approximately 0.6 inches of water in the venturi throat 134. The slight negative static pressure is desirable in that it compensates for normal variations in the conditions of the drying-conveying gas conditions which tend to increase the static pressure and prevents a positive static pressure from occurring in the venturi throat. Normal variations in the gas flow conditions are due, for example, to fan speed variations and heating variations. Further, the wall of the diverging nozzle 142 is configured to form a smooth curved surface blending with the transition from the horizontal to the vertical second section 124B of the second duct 124. Toward this objective, the portion of the bottom wall surface 144 of the diverging nozzle 142 extending from the venturi throat 134 is coextensive with the wall of the venturi throat 134, and at the outlet end of the diverging nozzle 142 the bottom wall surface 144 smoothly curves upwardly to meet the wall of the vertical second duct section 124B.

A further advantageous embodiment of a pneumatic conveying and drying apparatus, generally denoted as the numeral 210, is illustrated in FIG. 5. The apparatus 210 is shown as including heater means 212 such as, for example, a natural gas-fired burner or electric heater, for heating the tobacco treating-conveying gas, a tobacco-gas separator device 214, preferably of the tangential type, and conveying gas moving means 216, such as a fan or blower located upstream of a conveying gas inlet 218 of the heater means 212. A first duct 220 fluidly interconnects a hot conveying gas outlet 222 of the separator 214 to the inlet 218 of the heater means 212, and the conveying gas moving means 216 is operatively located in the first duct 220.

A second duct 224 is fluidly connected to a hot conveying gas outlet 226 of the heater means 212 and includes an arcuate upwardly curved elbow at the opposite end. When continued reference to FIG. 5 and additional reference to FIG. 6 a converging-diverging venturi 230 is located in flow-through communication between the elbow of the second duct 224 and an entrance 228 of the tobacco-gas separator 214. A tobacco feed means 232 is located to feed tobacco particles to be dried directly into the throat 234 of the venturi 230.

Figure 6:
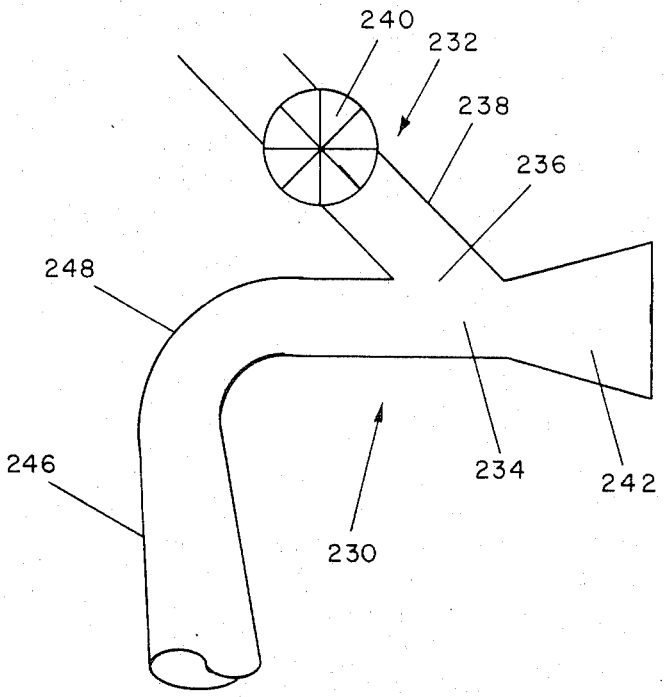

As can be best seen in FIG. 6, the tobacco feed means 232 comprises an aperture 236 formed in the wall of the venturi 230 at the venturi throat through which the tobacco to be treated will enter into the venturi throat 234 and be entrained in the heated gas flowing from the heater means 212. Preferably, the flow-through area of the tobacco aperture 236 in the venturi throat wall is substantially equal to the cross-sectional area of the throat 234. The tobacco feed means 232 further includes tobacco conduit means 238 associated with the tobacco aperture 236 for channeling tobacco particles to be treated to the tobacco aperture 236. Gate means 240 is located in the tobacco conduit 238 and is adapted to selectively open and close the tobacco conduit means 238 to control the passage of tobacco particles into the venturi throat 234. As shown, the gate means 240 is a multi-vaned rotary valve. In addition, the tobacco feed means 232 is configured to feed or direct tobacco particles into the venturi throat 234 in the general direction of the flow of treating-conveying gas flowing through the venturi throat 234. Toward this objective, as can be best seen in FIG. 6, the tobacco conduit 238 is sloped in the direction of gas flow through the venturi throat 234. The angled conduit wall presents an obtuse angle to the venturi throat wall which functions to prevent aspiration of ambient air into the venturi throat when the gate means is opened.

The converging-diverging venturi 230 is appropriately sized for the flow conditions through the apparatus 210 to provide substantially a zero treating-conveying gas static pressure in the venturi throat 234 as the gas flows therethrough. Preferably, the venturi 230 is sized to provide a slight negative treating-conveying gas static pressure of, for example, approximately 0.6 inches of water in the venturi throat 234. The slight negative static pressure is desirable in that it compensates for normal variations in the conditions of the drying-conveying gas conditions which tend to increase the static pressure and prevents a positive static pressure from occurring in the venturi throat. Normal variations in the gas flow conditions are due, for example, to fan speed variations and heating variations. The diverging nozzle 242 of the venturi 230 is substantially horizontally oriented having its outlet end located essentially immediately at the entrance 228 into the separator device 214. The converging nozzle 246 of the venturi 230 is substantially vertically oriented with its inlet end in communication with the elbow of the second duct means 224 and is long enough to reduce the amount of turbulence in the gas flowing from the elbow before the gas reaches the venturi throat 234 and minimize the wall effects due to the change of direction through the elbow. The converging nozzle 246 essentially uniformly converges upwardly and communicates with the venturi throat 234 through a curved neck portion 248 having a substantially constant cross-sectional flow area. The cross-sectional area of the neck portion 248 is substantially equal to the cross-sectional area of the venturi throat 234.

In all three of the embodiments of FIG. 1 through 6, the substantially zero treating-conveying gas static pressure in the venturi throat eliminates the leaking of treating gas from and leaking of the ambient atmosphere into the apparatus as the tobacco feed means is activated to introduce the tobacco particles to be treated into the venturi throat.

The foregoing detailed description is given primarily for clearness of understanding and no unnecessary limitations should be understood therefrom for modifications will become obvious to those skilled in the art and may be made without departing from the spirit of the invention or scope of the appended claims.

What is claimed is:

1. An apparatus for treating tobacco particles comprising:

heater means for heating tobacco treating-conveying gas passing therethrough;

a tobacco-gas separator device located downstream of said heater means;

first duct means fluidly interconnecting the gas outlet of the tobacco-gas separator device to the gas inlet of the heater means;

gas moving means located in the first duct means upstream of the heater means for circulating the treating conveying gas through the apparatus;

second duct means fluidly interconnecting the hot tobacco treating-conveying gas outlet of said heater means to the entrance to the tobacco-gas separator device;

a converging-diverging venturi located in the second duct means sized to provide substantially a zero treating-conveying gas static pressure in the throat of the venturi as the treating-conveying gas flows therethrough; and, tobacco feed means for feeding tobacco particles to be treated into the throat of the venturi.

2. The apparatus of claim 1, wherein the tobacco feed means comprises:

an aperture formed in the wall of the venturi at the throat of the venturi through which the tobacco to be treated enters the venturi throat;

tobacco conduit means associated with the aperture in the throat for channeling tobacco particles to the aperture in the venturi throat; and, gate means located in the tobacco conduit means adapted to selectively open and close the tobacco conduit means and thereby control the passage of tobacco particles into the venturi throat.

3. The apparatus of claim 2, wherein the flow-through area of the tobacco aperture in the venturi throat wall is substantially equal to the cross-sectional area of the venturi throat.

4. The apparatus of claim 2, wherein the gate means is a multi-vaned rotary valve device.

5. The apparatus of claim 2, wherein the wall of the tobacco conduit forms an obtuse angle with the wall of the venturi throat at the upstream side of the aperture in the venturi throat.

6. The apparatus of claim 1, wherein the venturi is sized to provide a slight negative treating gas static pressure in the venturi throat.

7. The apparatus of claim 1, wherein the tobacco feed means feeds the tobacco particles into the venturi throat in the general direction of flow of the conveying and treating gas flowing through the venturi throat.

8. An apparatus for treating tobacco particles comprising:

heater means for heating tobacco treating-conveying gas passing therethrough;

a tobacco-gas separator device located downstream of said heater means;

first duct means fluidly interconnecting the gas outlet of the tobacco-gas separator device and the gas inlet of the heater means;

gas moving means located in the first duct means upstream of the heater means for circulating the treating-conveying gas through the apparatus;

second duct means fluidly interconnecting the hot tobacco treating-conveying gas outlet of said heater means to the entrance to the tobacco-gas separator device, the second duct means having a first section and a second generally vertical section located downstream of the generally first section;

a converging-diverging venturi located in the horizontal section of the second duct means sized to provide substantially a zero conveying gas static pressure in the throat of the venturi as the treating-conveying gas flows therethrough; and, tobacco feed means for feeding tobacco particles to be treated into the throat of the venturi.

9. The apparatus of claim 8, wherein the diverging venturi nozzle wall is configured to form a smooth curved surface blending with the transition to the vertical section of the second duct.

10. The apparatus of claim 9, wherein a portion of the bottom wall surface of the diverging venturi nozzle is coextensive with the wall of the venturi throat.

11. The apparatus of claim 9, wherein the tobacco feed means comprises:

an aperture formed in the wall of the venturi at the throat of the venturi through which the tobacco to be treated enters the venturi throat;

tobacco conduit means associated with the aperture in the venturi throat for channeling tobacco particles to the aperture in the venturi throat; and gate means located in the tobacco duct means adapted to selectively open and close the tobacco duct means and thereby control the passage of tobacco particles into the venturi throat.

12. The apparatus of claim 11, wherein the flow-through area of the tobacco aperture in the venturi throat wall is substantially equal to the cross-sectional area of the venturi throat.

13. The apparatus of claim 11, wherein the gate means is a multi-vaned rotary valve device

14. The apparatus of claim 11, wherein the wall of the tobacco conduit forms an obtuse angle with the wall of the venturi throat at the upstream side of the aperture in the venturi.

15. The apparatus of claim 8, wherein the venturi is sized to provide a slight negative treating gas static pressure in the venturi throat.

16. The apparatus of claim 8, wherein the tobacco feed means feeds the tobacco particles into the venturi throat in the general direction of flow of conveying treating gas flowing through the venturi throat.

17. An apparatus for treating tobacco particles comprising:

heater means for heating tobacco treating-conveying gas passing therethrough;

a tobacco-gas separator device located downstream of said heater means;

first duct means fluidly interconnecting the gas outlet of the tobacco-gas separating device and the gas inlet of the heater means;

gas moving means located in the first duct means upstream of the heater means for circulating the treating-conveying gas through the apparatus;

a converging-diverging venturi located between the heater means and tobacco-gas separator device, the converging nozzle of the venturi being substantially vertically oriented and the diverging nozzle of the separator device being substantially horizontally oriented, the venturi being sized to provide substantially a zero treating-conveying gas static pressure in the throat of the venturi as the gas flows therethrough;

second duct means fluidly interconnecting the hot tobacco heating-conveying gas outlet of the heater means to the converging nozzle of the venturi; and, tobacco feed means for feeding tobacco particles to be treated into the throat of the venturi.

18. The apparatus of claim 17, wherein the diverging venturi nozzle is located at the into the tobacco-gas separator device.

19. The apparatus of claim 17, wherein the tobacco feed means comprises:

an aperture formed in the wall of the venturi at the throat of the venturi through which the tobacco to be treated enters the venturi throat;

tobacco conduit means associated with the aperture in the venturi throat for channeling tobacco particles to the aperture in the venturi throat; and, gate means located in the tobacco duct means adapted to selectively open and close the tobacco duct means and thereby control the passage of tobacco particles into the venturi throat.

20. The apparatus of claim 19, wherein the flow-through area of the tobacco aperture in the venturi throat is substantially equal to the cross-sectional area of the venturi throat.

21. The apparatus of claim 19, wherein the gate means is a multi-vaned rotary valve.

22. The apparatus of claim 19, wherein the wall of the tobacco conduit forms an obtuse angle with the wall of the venturi throat at the upstream side of the aperture in the venturi.

23. The apparatus of claim 17, wherein the venturi is sized to provide a slight negative treating-conveying gas static pressure.

24. The apparatus of claim 17, wherein the tobacco feed means the tobacco particles into the venturi throat in the general direction of flow of the treating-conveying gas flowing through the venturi throat.

* * * * *